US005535495A

United States Patent [19]

Gutowski

[11] Patent Number: 5,535,495

[45] Date of Patent: Jul. 16, 1996

[54] DIE CAST BULLET MANUFACTURING PROCESS

[76] Inventor: Donald A. Gutowski, 4556 N. Ottawa Ave., Norridge, Ill. 60656

[21] Appl. No.: 333,776

[22] Filed: Nov. 3, 1994

[51] Int. Cl.[6] ..... B21K 21/06

[52] U.S. Cl. ..... 29/1.22; 29/1.23

[58] Field of Search ..... 29/1.22, 1.23, 29/1.2

[56] References Cited

U.S. PATENT DOCUMENTS

| | | | |
|---|---|---|---|
| 2,620,433 | 12/1952 | Denneen et al. . | |
| 3,561,103 | 2/1971 | Dent . | |
| 3,704,193 | 11/1972 | Valdo et al. . | |
| 4,537,242 | 8/1985 | Pryor et al. . | |
| 4,610,061 | 9/1986 | Halverson . | |
| 4,624,297 | 11/1986 | Clausen | 29/1.22 |
| 4,660,263 | 4/1987 | Kosteck . | |
| 4,793,037 | 12/1988 | Carter . | |
| 5,017,245 | 5/1991 | Suzuki et al. . | |

FOREIGN PATENT DOCUMENTS 57-192204 of 1982 Japan .

OTHER PUBLICATIONS

Bosselman, K., *Shooting Zinc,* Handloaders Digest, 12th Edition, pp. 128–132.

Valway, S. E., Martyny, J. W., Miller, J. R., Cook, M., Mangione, E. J., *Lead Absorption in Indoor Firing Range Users,* Am. J. Public Health, 79:1029–1032 (1989).

*Reducing Exposures to Airborne Lead in Indoor Firing Ranges—United States,* MMWR 32:483–484 (1983).

*Primary Examiner*—David P. Bryant
*Attorney, Agent, or Firm*—Wallenstein & Wagner, Ltd.

[57] ABSTRACT

The invention provides a zinc alloy die cast bullet (100) and a method for manufacturing the same for use primarily in indoor shooting ranges. The use of a zinc die cast alloy eliminates toxic lead vapors and dust which result from the use of lead in bullets. The bullet (100) is made by heating a zinc metal alloy to a molten state (30), injecting the molten alloy into a preformed cavity within a mold under a pressure (20, 60), and sizing the cast bullet at a temperature greater than 70° F. (30, 70).

33 Claims, 1 Drawing Sheet

DIE CAST BULLET MANUFACTURING PROCESS

DESCRIPTION

1. Technical Field

The present invention relates to ammunition for small firearms, and particularly, to non-lead die cast bullets and a method for manufacturing the same. The non-lead die cast bullets are preferably for indoor target use, although they may be used outdoors.

BACKGROUND OF THE INVENTION

Recently the hazards of lead vapors and lead dust caused by the use of lead bullets and copper jacketed lead bullets have been of great concern among environmentalists and sportsmen. These hazards are of particular concern to users and employees of indoor Shooting ranges. Lead vapors from the bullet are caused by the hot burning gases pressing upon the exposed lead base of the bullet while propelling it through the gun barrel. The use of a copper jacket, copper plating, or other material covering the base of the bullet has been successful in eliminating lead vapors from this source. Examples of such uses are disclosed in U.S. Pat. Nos. 4,610,061, 4,660,263, and 4,793,037. However, these methods of preventing lead vapors also add significantly to the cost of manufacturing the bullet.

Lead dust and vapors are also caused by the bullet striking a target backstop. Efforts have been made to reduce the lead dust and vapors caused by the striking bullet through the use of water entrapment backstop systems. However, the installation of such systems, and the subsequent hazardous waste clean-up, i.e., the removal of lead from the water, adds significantly to the operating costs of indoor ranges. Many ranges cannot afford the costly installation of water entrapment systems, or the high cost of operating them. Consequently, a low cost alternative is needed to prevent the hazards of toxic lead vapors and lead dust caused by lead bullets and copper jacketed lead bullets.

SUMMARY OF THE INVENTION

It is believed that the present invention satisfies the above noted needs and fulfills the shortcomings found in prior systems. According to a first aspect of the present invention, the bullets of the present invention are made of a zinc alloy that is cast. The use of such bullets substantially eliminates toxic vapors and dust, and the environmental hazards that are caused by such toxic vapors and dust. However, due to the difference in physical properties, the use of a zinc alloy material as an alternative to lead has been previously rejected. Specifically, several problems prevented zinc alloy bullets from being made in high volumes. For example, the lower density and greater porosity of the die cast zinc alloy material makes casting a uniform bullet more difficult than casting a dense, less porous lead bullet. The zinc alloy material is also much harder than lead. Consequently, greater pressures are required to fill a mold and size a bullet made from a zinc alloy than from lead. This increase in pressure required to size a zinc alloy bullet can lead to distortion and induce stress fractures to grow in the zinc alloy material.

To overcome such problems, according to another aspect of the present invention, the non-lead bullet is constructed or manufactured by a method which includes providing a casting zinc metal alloy. A preferable composition of the alloy includes aluminum (between about 3.5% and about 4.3% by weight of the total weight of the alloy), magnesium (between about 0.03% and about 0.08% by weight) and zinc (between about 95.62% and about 96.47% by weight).

The zinc alloy is heated to a molten state and injected into a preformed cavity in a mold while under a pressure greater than atmospheric pressure to form the bullet. By injecting the molten zinc alloy under pressure, the porosity of the zinc alloy is minimized, and a smaller opening in the mold can be used to inject the molten zinc alloy into the mold. The cast bullet is removed from the cavity in the mold, and the sprue i.e., waste metal left in the opening of the mold after casting, is removed. Because a smaller opening in the mold can be used, unlike with the manufacture of lead bullets, the resulting sprue can be removed from the zinc alloy bullet by hand. This eliminates an additional operation in which the sprue would have to be machined or cut away from a bullet made from lead. Finally, the bullet is sized at a temperature greater than 70° F. At elevated temperatures, the zinc alloy is in a more ductile state. As a result, sizing the zinc alloy bullet at an elevated temperature eliminates the potential of distortion and stress fractures in the material.

According to another aspect of the present invention, the cast bullet is sized at a temperature in a range between about 250° F. and about 400° F. The step of sizing the cast bullet is performed by either pushing the cast bullet through a die, rotary swaging the cast bullet, or rolling the cast bullet.

According to still another aspect of the present invention, the sized bullet is coated or barrel plated with a generally non-porous preservative capable of inhibiting the formation of oxides on the sized bullet.

Other advantages and aspects of the present invention will become apparent upon reading the following description of the drawings and detailed description of the invention.

BRIEF DESCRIPTION OF THE DRAWINGS

The present invention will be better understood from the following detailed description taken in conjunction with the accompanying drawings, wherein.

DETAILED DESCRIPTION

Figure 1:
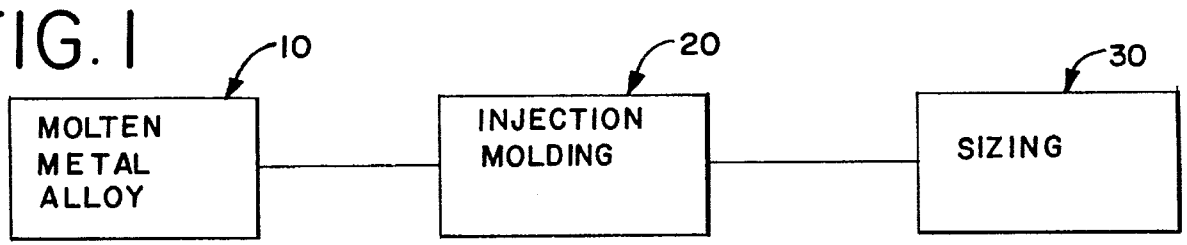
FIG. 1 is a block schematic diagram of a first method for forming the bullet in accordance with the teaching of the present invention.

While this invention is susceptible of embodiment in many different forms, there is shown in the drawings and will herein be described in detail preferred methods of manufacture with the understanding that the present disclosure is to be considered as an exemplification of the principles of the invention and is not intended to limit the broad aspect of the invention to the embodiments illustrated.

FIG. 1 illustrates generally the preferred method of manufacturing the non-lead metal alloy bullet, generally designated by reference number 100, according to the present invention. The method comprises the steps of first providing a molten metal casting alloy (block 10), injecting the molten casting metal alloy into a preformed cavity in a mold under a pressure greater than atmospheric pressure to form the cast bullet, generally shown in the block designated 20. The cast bullet 100 is then sized at a temperature greater than 70° F. (block designated 30).

Figure 2:
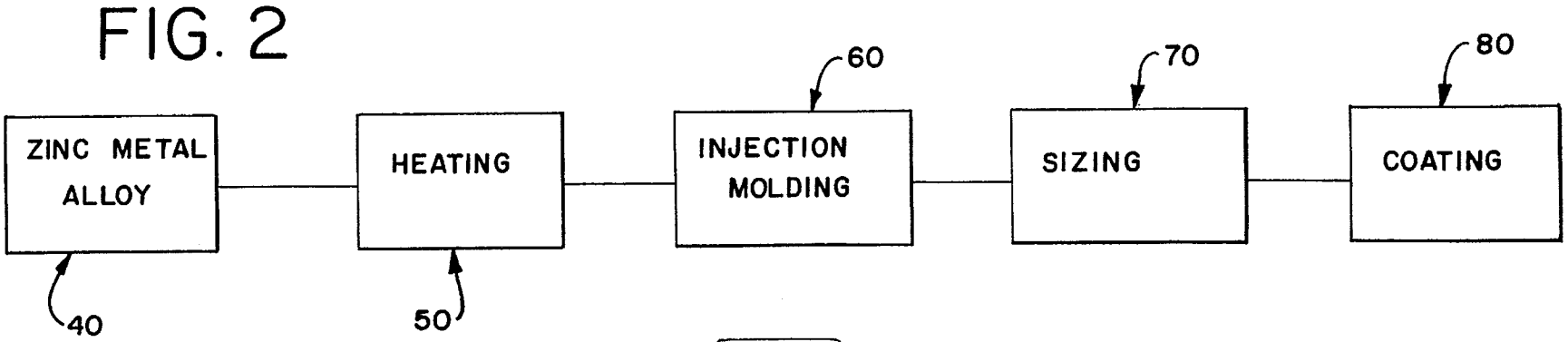
FIG. 2 is a block schematic diagram of a second method for forming the bullet in accordance with the teaching of the present invention; and, FIG. 3 is a side elevation view of a bullet manufactured by the method in accordance with the teaching of the present invention.
Figure 3:
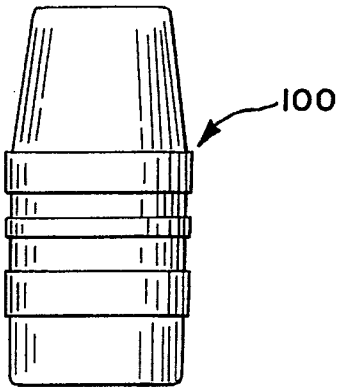

FIG. 2 illustrates another preferred method of manufacturing the non-lead metal alloy bullet 100. This latter method comprises the first step of providing a casting zinc metal alloy 40. The zinc alloy 40 is heated to a molten state 50, and injected under pressure (greater than atmospheric pressure) into a preformed cavity within a mold to form a bullet 60. The cast bullet is thereafter sized at a temperature greater than 70° F. (block 70). The sized bullet is then coated with a preservative capable of inhibiting the formation of oxides on the sized bullet (block 80).

In both embodiments, the cast bullet 100 is sized using well known, conventional metal working techniques. Preferably, the cast bullets are sized by extrusion, rotary swaging, or rolling. In the extrusion method, the cast bullet is forced through a hard die having the desired final dimensions. Rotary swaging involves reducing the diameter of the bullet and making the bullet more uniform by the reciprocating radial movement of a plurality of dies. In rolling, the thickness or diameter of the bullet is reduced by compressive forces exerted by a pair of rotating rolls or sliding flat dies.

The sizing process is performed at a temperature greater than approximately 70° F. At this elevated temperature, the alloy is in a more ductile state than that at room temperature, and can be more readily worked without distorting the material and inducing stress fractures to grow. The bullet is removed from the mold, separated from the sprue, and immediately sized while it is still at an elevated temperature, or it can be removed from the mold, separated from the sprue, cooled, re-heated, and then sized at an elevated temperature. These alternative methods have the same overall effect on the final product, however, since the former method requires the use of less energy, it is preferred over the later method.

Preferably, a sizing lubricant is applied to the cast bullet before it is sized. The lubricant aids in the sizing operation, and leaves a residual coating on the sized bullet which acts as a preservative, inhibiting the formation of oxides on the sized bullet. For example, a liquid bullet lube sold under the commercial name Rooster Jacket, manufactured by Rooster Labs, P.O. Box 412514, Kansas City, Mo. 64141, can be used. Sizing lubricants are also available in solid stick form which can be used to coat the bullet at elevated temperatures. One such lubricant is sold under the commercial name Zambini (melting point 220° F.), manufactured by Rooster Labs, P.O. Box 412514, Kansas City, Mo. 64141.

Alternatively, the bullet can be sizing without using a lubricant. In this case, after the bullet is sized, the bullet is coated with a generally non-porous preservative capable of inhibiting the formation of oxides on the sized bullet. Alternatively, the sized bullet can be barrel-plated with a metal coating using metal plating techniques commonly known in the industry. Preferably, the sized bullet is barrel coated with the metal copper.

While the present invention contemplates a non-lead metal alloy, in the preferred method of manufacture and product, an alloy having one or more of the metals in the group of aluminum, magnesium, zinc, and copper is provided. Preferably, the metals are present in the following proportions to form a predominantly zinc alloy:

Aluminum—between about 3.5% and about 4.3% by weight of the total weight of the alloy;

Magnesium—between about 0.03% and about 0.08% by weight of the total weight of the alloy; and, Zinc—between about 95.62% and about 96.47% by weight of the total weight of the alloy.

A commercially available zinc alloy having such a composition is sold under the tradename Zamac 3. Zamac 3 has the following physical properties: a melting point temperature of about 717° F.; a density of approximately 0.24 lbs/in$^3$; and, a Brinell Hardness of about 82.

The zinc alloy is heated to a molten state at approximately 717° F. Once in a molten state, the zinc alloy is injected into a preformed cavity in a mold under a pressure above approximately 3,000 psi. The zinc alloy remains in the mold until a skin forms (approximately 0.5–2.0 seconds). The cast bullet is removed from the mold, the sprue is removed from the cast bullet, and the bullet is sized at a temperature in a range preferably between about 250° F. and about 400° F. If the bullet is sized at a temperature too close to the melting point, i.e., 717° F., deformation can occur making it difficult to produce a uniform final product. If the bullet is sized at a temperature which is too low, such as room temperature (70° F.), the zinc alloy is not plastic or ductile enough, and deformation which can lead to stress fractures can occur. And, as noted above, the step of sizing the cast bullet may be performed by either pushing the cast bullet through a hard die, rotary swaging the cast bullet, or rolling the cast bullet.

As explained above, the cast bullet can be coated with a sizing lubricant which acts as a preservative before the sizing operation, or the sized bullet can be coated with a preservative or plated with metal, preferably copper, after the sizing operation. In each case, the coating inhibits the formation of oxides on the sized bullet.

The potential exists for the use of zinc alloy bullets by law enforcement agencies throughout the country due to their extensive use of indoor training ranges. Such use, however, should approximate the recoil (energy measured in foot pounds) of bullets which are used outside of the indoor training facilities. The formula for energy shows that the reduction in bullet mass caused by using a zinc alloy rather than lead can be made up by a small increase in velocity to produce the equivalent recoil (energy):

$$E = \frac{MV^2}{450240} = \text{Recoil in Foot Pounds}$$

Where, E=Energy in Foot Pounds; M=Weight of Projectile and Powder in Grains; and, V=Velocity of Projectile in Feet/Second. In order to approximate the recoil of heavier lead bullets in use by law enforcement agencies, the bullet should be as heavy as possible without compromising velocity levels. This can be accomplished by designing the bullet to occupy the maximum external and internal dimensions of a specific cartridge. The Sporting Arms and Ammunition Manufacturers Institute, Inc. (SAAMI) located at 11 Mile Hill Road, Newtown, Conn. 06470 sets the maximum overall lengths (OAL) for different caliber munitions. For example, the maximum OAL of a 0.357 magnum cartridge is 1.590 inches; the maximum OAL of a 9 mm cartridge is 1.169 inches; the maximum OAL of a 0.38 Special cartridge is 1.550 inches; and, the maximum OAL of a 0.45 caliber cartridge is 1.275 inches. Therefore, by using the maximum OAL specified by SAAMI for a specific cartridge, the recoil (energy) of a typical lead bullet can be more closely approximated. This can be accomplished in two ways. Material can be added to the base of the zinc alloy bullet, thus, extending the length of the bullet in the cartridge case and increasing the overall weight of the bullet. Also, additional gunpowder, up to the maximum pressure limits of the cartridge, can be added to the cartridge. The bullet can be extended further into the cartridge case in balance with the amount of gunpowder present in the cartridge. However, the gunpowder should not be excessively compressed. This can cause dangerously high internal pressures when the weapon is fired. By redesigning the bullets in the above described manner, one can achieve normal standard commercial energy and pressure levels in most caliber ammunition.

Target shooters are more concerned with uniform accuracy, and less concerned with velocity and energy. Consequently, the main concern among target shooters substituting zinc alloy bullets for lead bullets is accuracy. As explained above, by utilizing the maximum OAL of a specific cartridge, the OAL of the zinc alloy bullet can be increased. Within limits, bullets having a greater OAL are more aerodynamically stable than shorter projectiles. Thus, the lighter zinc alloy bullets can be redesigned by increasing the length of the base of the bullet to provide an aerodynamically stable, and uniformly accurate projectile for use in target shooting.

While the preferred embodiments have been illustrated and described, numerous changes and modifications can be made without significantly departing from the spirit and scope of this invention, which is only limited by the scope of the accompanying claims.

I claim:

1. A method of manufacturing a cast bullet comprising the steps of:

injecting a molten casting metal alloy into a preformed cavity in a mold under a pressure greater than atmospheric pressure to form the cast bullet; and, sizing the cast bullet at a temperature greater than 70° F.

2. The method of claim 1 further including the step of removing the cast bullet from the mold.

3. The method of claim 1 wherein the cast bullet includes at least one sprue.

4. The method of claim 3 further including the step of removing the sprue from the cast bullet.

5. The method of claim 1 wherein the molten casting metal alloy includes only non-lead metals.

6. The method of claim 5 wherein the molten casting metal alloy further includes the metal zinc.

7. The method of claim 6 wherein the molten casting metal alloy further includes one or more of the metals in the group of aluminum, magnesium and copper.

8. The method of claim 7 wherein the molten casting metal alloy further includes the metals in the following proportions:

aluminum—between about 3.5% and about 4.3% by weight of the total weight of the metal alloy;

magnesium—between about 0.03% and about 0.08% by weight of the total weight of the metal alloy; and, zinc—between about 95.62% and about 96.47% by weight of the total weight of the metal alloy.

9. The method of claim 8 wherein the step of injecting the molten casting metal alloy into the preformed cavity further includes the step of regulating the pressure on the molten alloy to a pressure above 3,000 psi.

10. The method of claim 8 further including the step of forming the molten casting metal alloy by heating the casting metal alloy above about 717° F.

11. The method of claim 1 wherein the step of sizing the cast bullet is performed at a temperature in a range between about 250° F. and about 400° F.

12. The method of claim 1 wherein the step of sizing the cast bullet is performed by one of pushing the cast bullet through a die, rotary swaging the cast bullet, or rolling the cast bullet.

13. The method of claim 1 further including the step of coating the cast bullet with a sizing lubricant capable of inhibiting the formation of oxides on the sized bullet.

14. The method of claim 1 further including the step of coating the sized bullet with a generally non-porous preservative capable of inhibiting the formation of oxides on the sized bullet.

15. The method of claim 1 further including the step of barrel plating the cast bullet with a metal capable of inhibiting the formation of oxides on the sized bullet.

16. The method of claim 15 wherein the barrel plating metal is copper.

17. The method of claim 1 further including the step of cooling the cast bullet and reheating the cast bullet to the desired temperature for sizing the cast bullet.

18. The method of claim 1 further including the step of cooling the cast bullet to the desired temperature for sizing the cast bullet.

19. A method of manufacturing a cast bullet comprising the steps of:

providing a casting zinc metal alloy;

heating the zinc alloy to a molten state;

injecting the molten zinc alloy into a preformed cavity in a mold under a pressure greater than atmospheric pressure to form the cast bullet;

sizing the cast bullet at a temperature greater than 70° F.

20. The method of claim 19 further including the step of removing the cast bullet from the mold.

21. The method of claim 19 wherein the cast bullet includes at least one sprue.

22. The method of claim 21 further including the step of removing the sprue from the cast bullet.

23. The method of claim 19 wherein the zinc metal alloy further includes one or more of the metals in the group of aluminum, magnesium and copper.

24. The method of claim 23 wherein the zinc metal alloy further includes the metals in the following proportions:

aluminum—between about 3.5% and about 4.3% by weight of the total weight of the alloy;

magnesium—between about 0.03% and about 0.08% by weight of the total weight of the alloy; and, zinc—between about 95.62% and about 96.47% by weight of the total weight of the alloy.

25. The method of claim 24 wherein the molten zinc alloy is formed by heating the casting zinc metal alloy above about 717° F. and wherein the step of injecting the molten zinc alloy into the preformed cavity further includes the step of regulating the pressure on the molten zinc alloy to a pressure above 3,000 psi.

26. The method of claim 19 wherein the step of sizing the cast bullet is at a temperature in a range between about 250° F. and about 400° F.

27. The method of claim 19 further including the step of coating the cast bullet with a sizing lubricant capable of inhibiting the formation of oxides on the sized bullet.

28. The method of claim 19 further including the step of coating the sized bullet with a generally non-porous preservative capable of inhibiting the formation of oxides on the sized bullet.

29. The method of claim 19 further including the step of barrel plating the cast bullet with a metal capable of inhibiting the formation of oxides on the sized bullet.

30. The method of claim 29 wherein the barrel plating metal is copper.

31. The method of claim 19 wherein the step of sizing the cast bullet is performed by one of pushing the cast bullet through a die, rotary swaging the cast bullet, and rolling the cast bullet.

32. The method of claim 19 further including the step of cooling the cast bullet and reheating the cast bullet to the desired temperature for sizing the cast bullet.

33. The method of claim 19 further including the step of cooling the cast bullet to the desired temperature for sizing the cast bullet.

* * * * *